United States Patent [19]

Sullivan et al.

[11] 4,240,242

[45] Dec. 23, 1980

[54] STERILE CAPPING METHOD FOR A PLURALITY OF I.V. BOTTLES

[76] Inventors: James J. Sullivan, 1349 N. Foothill Rd., Ojai, Calif. 93023; Charles M. Grey, 1518 Conestoga Ct., Redlands, Calif. 92373

[21] Appl. No.: 49,931

[22] Filed: Jun. 18, 1979

[51] Int. Cl.[3] ..... B65B 7/28; B67B 3/22

[52] U.S. Cl. ..... 53/471; 53/474; 53/485

[58] Field of Search ..... 53/471, 474, 485, 487, 53/489

[56] References Cited

U.S. PATENT DOCUMENTS

| | | | |
|---|---|---|---|
| 2,329,928 | 9/1943 | Mulligan | 53/474 X |
| 3,143,471 | 8/1964 | Coady | 53/474 X |
| 3,245,194 | 4/1966 | Carski | 53/471 X |
| 3,598,379 | 8/1971 | Laupheimer | 53/471 X |

*Primary Examiner*—Horace M. Culver
*Attorney, Agent, or Firm*—Poms, Smith, Lande & Rose

[57] ABSTRACT

A method of sterile capping a plurality of I.V. bottles with temporary sterile caps. A plurality of caps are provided in a single sterile package, which package is opened within the confines of a sterile working environment and the caps distributed face-up on a working surface. Packing caps are removed from I.V. bottles within the sterile environment and dilutant added to the bottles. The bottles are then sequentially inverted and press-fit into corresponding temporary caps to achieve a sterile sealing relationship between the bottles and caps.

The described method results in a large savings of preparation time, produces less litter, and eliminates a bruised or "red" palm problem encountered in the prior art.

10 Claims, 6 Drawing Figures

STERILE CAPPING METHOD FOR A PLURALITY OF I.V. BOTTLES

BACKGROUND OF THE INVENTION

1. Field of the Invention

This invention relates to the medical arts, and more particularly to a method of providing a plurality of I.V. bottles with sterile caps.

2. Description of the Prior Art

I.V. bottles are generally furnished to hospitals with a measured amount of dry powder or liquid inside the bottle. The hospital itself adds a dilutant to the powder inside the bottle, or adds powder where the bottle initially contains a liquid, so that its contents can be administered intravenously to a patient. The amount of dilutant or powder added to each bottle is determined by the particular patient needs.

Preparation of the I.V. bottles is typically done at a centralized laboratory facility removed from the patient areas of the hospital. In order to keep the bottles sterile from the time dilutant is added until the fluid is administered to a patient, a temporary sterile cap is placed over the bottle once the desired amount of dilutant has been added. The bottle is then transported to the patient, where the temporary cap is removed and the I.V. fluid administered.

In order to avoid contamination, dilutant is added to the bottle and the temporary cap is affixed within the confines of a sterile, laminar flow hood. The temporary caps are provided individually, each cap having a paper wrapping heat-sealed over its opening to keep the inside of the cap sterile. When the cap is ready to be used, the paper is peeled off and discarded. Thus, a separate package must be opened each time an I.V. bottle is filled. While this does not pose any particular problem if only one or a few I.V bottles are needed, the demands on many modern hospitals are such that a very large volume of bottles must be supplied on a continuous basis. The need to unwrap a separate temporary cap for each of these bottles can be quite time consuming and adds to the demands made on the laboratory staff, in addition to tying up the laminar flow hood and restricting its availability for other purposes. The discarded wrapping for each cap also results in an accumulation of a large volume of litter over a period of time.

The method commonly used to affix the temporary caps to their respective I.V. bottles is also time consuming and can contribute to an overall reduction in efficiency for the hospital laboratory. Each I.V. bottle and its corresponding temporary cap is typically considered to comprise a unit; the preparation of one unit will be completed before work on the next unit begins. That is, even if there is more than one I.V. bottle within the hood, a single temporary cap will be unwrapped and affixed to a bottle by press-fitting it over the bottle neck before another cap is unwrapped. After the first bottle has been capped, one more cap is unwrapped and then pressed over the second bottle. When this is complete a third cap is unwrapped, and so on. Alternately, a number of caps may be individually unwrapped before capping the bottles. While either technique may be satisfactory for small scale production, they again consume a significant amount of preparation time when employed in the context of a large hospital with many patients. Furthermore, physically pressing a large number of temporary caps onto I.V. bottles has been found to bruise or otherwise irritate the palm of the I.V. technician or I.V. pharmacist who performs the operation.

SUMMARY OF THE INVENTION

In view of the above problems found in the prior art, it is an object of the present invention to provide an improved method for applying temporary sterile caps to a large volume of I.V. bottles.

A further object of the invention is the provision of a novel and improved method for sterile capping a plurality of I.V. bottles, which requires significantly less labor time than in the prior art.

Another object is the provision of a novel and improved method of capping a plurality of I.V. bottles with sterile temporary caps while producing less litter than in the prior art.

Still another object is the provision of a novel and improved method of capping a plurality of I.V. bottles with temporary bottle caps, without bruising or irritating the palm of the person capping the bottle.

In the achievement of the above objects, a plurality of press-fit type, disposal I.V. bottle caps are provided in a unitary sterile package. An equal number of I.V. bottles are placed within a sterile working enviroment, such as a laminar flow hood, and are capped in a single operation.

Desired amounts of dilutant are added to the I.V. bottles within the sterile working environment. The sterile package of bottle caps is opened within the working environment, and the caps distributed face-up on the floor. The I.V. bottles are then sequentially inverted and pressed into corresponding bottle caps until the caps are each press-fit into sterile sealing relationship on their respective bottles. At the end of this sequence, each of the I.V. bottles is capped and ready for transport to the patient, with a large reduction in preparation time and only a single cap package to be disposed of.

DESCRIPTION OF THE DRAWINGS

Further objects and features of the present invention will become apparent to those skilled in the art from the following detailed description thereof, taken in conjunction with the accompanying drawings, in which.

DETAILED DESCRIPTION OF THE INVENTION

Figure 1:
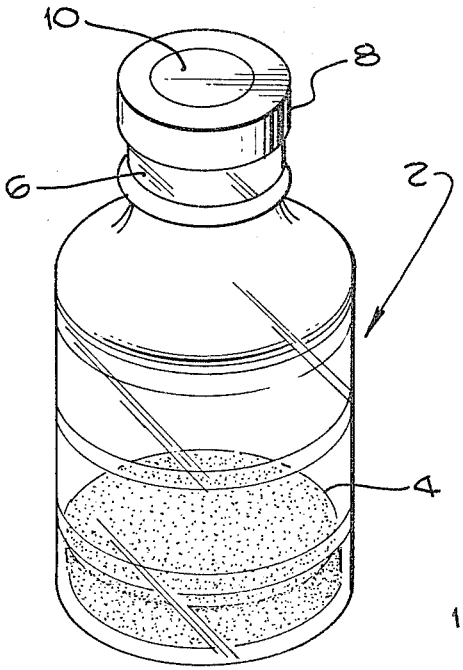
FIG. 1 is a perspective view of an I.V. bottle containing a powder and ready to receive dilutant.

Referring to FIG. 1, a typical I.V. bottle 2 as received by a hospital laboratory unit is shown. The bottle is provided by the manufacturer with a small amount of powder 4 inside, permitting the hospital to add a desired amount of dilutant so as to prepare a solution determined by individual patient needs. Alternatively, I.V. bottle 2 could initially be provided with a liquid to which powder is added by the technician. The bottle 2 has a neck portion 6 which is covered by a metallic cap 8. The central portion 10 of cap 8 is removable to expose thereunder a rubber diaphragm (shown in FIG. 3) which extends across the opening of neck 6. Cap 8 provides a sterile cover which keeps the rubber diaphragm and the contents of the bottle free from contamination.

Figure 2:
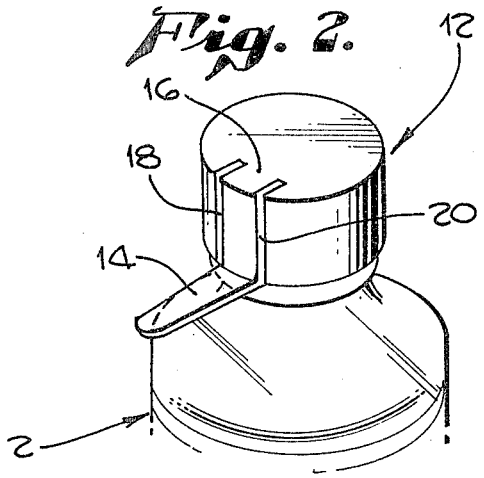
FIG. 2 is a perspective view of the upper portion of an I.V. bottle with a temporary sterile cap affixed over its neck.

In accordance with conventional practices, once the central metallic cap portion 10 has been removed and dilutant added to the bottle, a temporary cap 12 shown in FIG. 2 is press-fit over the neck of the bottle to keep it in a sterile condition during transport to the patient area. Temporary cap 12, which is of conventional construction, is typically formed from polyethylene with sufficient flexibility and resiliency to accommodate a press-fitting over the bottle neck and thereafter insure a sterile seal for the bottle. A break-away tab 14 extends outwardly from the lower edge of cap 12 and continues up the side of the cap to terminate at a pivot area 16 on the top. Tab 14, which is formed in a unitary construction with the remainder of the cap, is flanked by lateral webs 18 and 20 of reduced thickness. These webs maintain the seal for the bottle, but permit the tab to be broken away when it is desired to remove cap 12.

Figure 3:
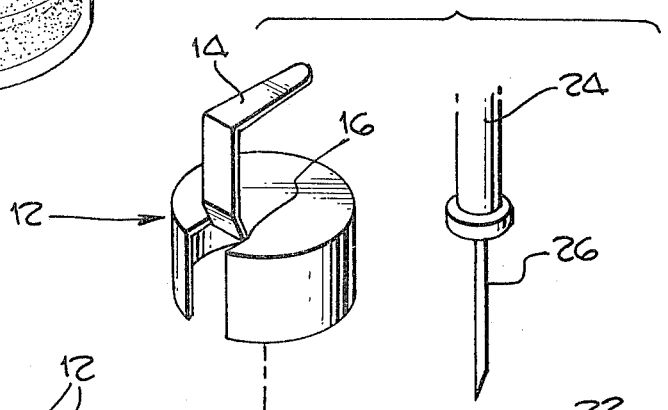
FIG. 3 is an exploded perspective view of an I.V. bottle with a hyperdermic needle positioned to add a dilutant to the bottle, and depicting a temporary sterile cap after removal from the bottle.

Referring now to FIG. 3, I.V. bottle 2 is shown with the central portion of cap 8 removed and the underlying rubber diaphragm 22 exposed. A hyperdermic syringe 24 is shown positioned above the bottle, with its needle 26 ready to be inserted through diaphragm 22 so that an appropriate amount of dilutant can be added to the bottle. The addition of dilutant is normally performed within a sterile hood, after which a temporary cap 12 is press-fit over the bottle neck. In FIG. 3 a temporary cap 12 is shown after it has been removed from bottle 2 at the patient area, tab 14 having been manually broken away and pivoted back to loosen the remainder of the cap and facilitate its removal from the bottle.

Figure 4:
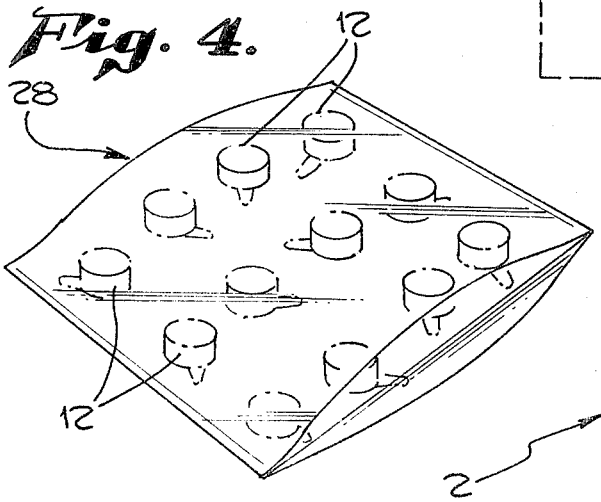
FIG. 4 is a perspective view of a unitary sterile package in accordance with the present invention, housing a plurality of sterile temporary I.V. bottle caps.
Figure 4:
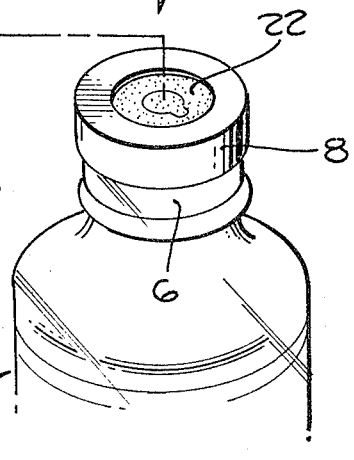

Referring now to FIG. 4, an important aspect of the present invention is shown, in accordance with which a plurality of temporary sterile caps 12 are provided in a unitary sterile package 28. Package 28 may be formed by any convenient means that will retain caps 12 in a sterile condition and permit the package to be easily opened to provide access to the caps. Preferably, package 28 is provided as a plastic bag which is sealed after caps 12 are added, and then placed in a conventional gas sterilizing chamber. The sterilizing chamber causes a sterilizing gas to permeate the bag and sterilize its contents. Any number of a plurality of caps 12 may be placed within a single package, although quantities of 12 or 25 have been found convenient to work with.

Figure 5:
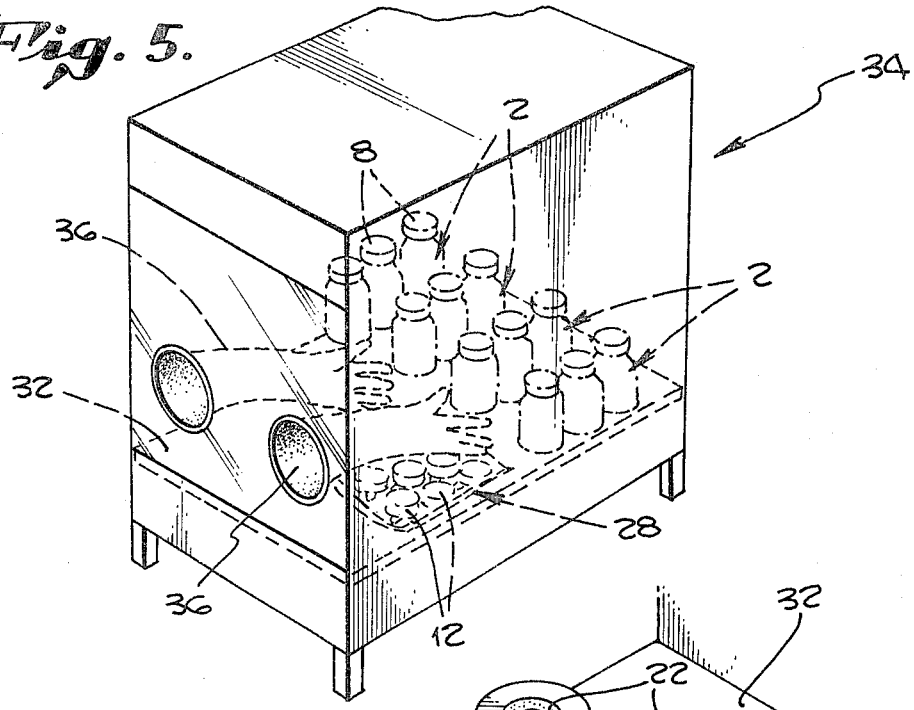
FIG. 5 is a perspective illustration of a sterile hood with I.V. bottles and a unitary package of temporary bottle caps ready to be assembled therein.
Figure 6:
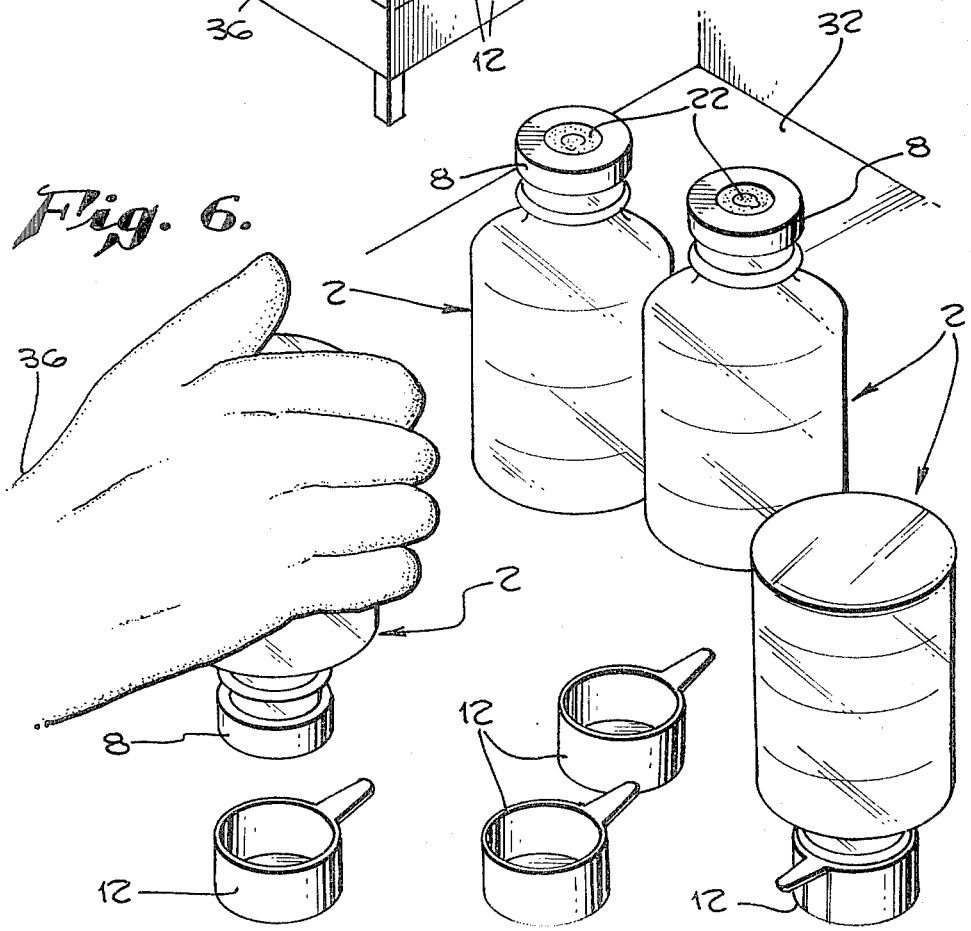
FIG. 6 is a perspective view of a plurality of I.V. bottles being press-fit into corresponding temporary sterile caps in accordance with the invention.

Referring now to FIGS. 5 and 6, the novel method of capping a plurality of I.V. bottles with temporary sterile caps from a single package 28 is illustrated. A plurality of bottles 2 are placed upright on the floor 32 of a sterile laminar flow hood 34 with their necks facing upward, along with a package 28 containing a plurality of sterile temporary caps 12. A pair of elongated rubber gloves 36 are built into one wall of the hood, enabling a technician to work with the I.V. bottles without interfering with the sterile environment of the hood.

Inside the hood the removable portions of the metallic bottle caps are taken off and dilutant is added to the bottles with a syringe, as described above. The package 28 of temporary caps is then opened, and each of the caps 12 is positioned face-up on the working surface floor of the hood, as shown in FIG. 6. The I.V. bottles, which now contain solutions of powder and dilutant, are rapidly and sequentially inverted and pressed over respective up-ended caps 12, so that their neck portions are inserted into the caps. Each bottle is press-fit into its corresponding cap until the cap is in sterile sealing relationship on the bottle neck. In this manner a relatively large number of bottles, corresponding in number to the number of temporary sterile caps within a single package 28, can be temporarily sealed in a single operation. The bottles are then removed from the hood and transported to the patient area as needed. Any unused caps can simply be left in place inside the hood until they are needed.

It has been found that the present method of providing a plurality of temporary sterile caps in a unitary package, as opposed to the prior art technique of individually packaging the caps, together with the technique of applying the bottles to the inverted caps in a unified operation as opposed to the prior art technique of applying the caps to the bottles one-at-a-time as each cap is unwrapped, results in a time savings in the order of 50 percent. In addition, considerably less litter is generated, since only a single wrapping must be disposed of, rather than many smaller wrappings. Furthermore, the problem of "red" or bruised palms is eliminated with this method.

While a particular embodiment of the invention has been shown and described, numerous variations thereof will occur to those skilled in the art. Accordingly, it is intended that the present invention be limited only by the terms of the appended claims.

We claim:

1. The method of preparing a plurality of IV bottles for administration to a patient, comprising the steps of:

sterile packaging a plurality of press-fit type, disposable I.V. bottle caps in a unitary package, providing a working environment with a working floor, adding desired amounts of dilutant to a plurality of I.V. bottles within said working environment, opening the bottle cap package within said working environment and distributing the caps therein in upward facing positions on said working floor, and sequentially pressing each of said IV bottles into a corresponding bottle cap until the caps are press-fit into sterile sealing relationship on their respective bottles.

2. The method of sterile capping a plurality of I.V. bottles, comprising:

distributing said bottles on a working floor in a working environment, distributing a corresponding plurality of press-fit type sterile bottle caps face up on said working floor, and sequentially pressing each of said I.V. bottles into a corresponding bottle cap until the caps are press-fit into sterile sealing relationship on their respective bottles.

3. The method of claims 1 or 2, each of said I.V. bottles having a neck portion and being initially positioned in an upright position on said working floor with its neck portion facing upward, wherein said bottles are inverted and pressed against corresponding bottle caps to press-fit said caps onto respective neck portions of said bottles.

4. The method of claim 2, wherein said bottle caps are introduced into said working environment in a unitary sterile package, and said package is opened within the working environment.

5. The method of claim 2, further including the step of adding desired amounts of dilutant to said I.V. bottles within said working environment prior to press-fitting the bottles into the caps.

6. The method of sterile capping a plurality of I.V. bottles, each of said bottles having a neck portion and an at least partially removable packing cap over the neck portion, comprising:

placing said bottles in a laminar hood, said hood having a floor surface, removing the removable portions of said packing caps from the neck portions of said bottles, distributing a corresponding plurality of press-fit type sterile bottle caps face up on the floor of the hood, and sequentially pressing the neck portion of each said I.V. bottle into a corresponding bottle cap until the caps are press-fit into sterile sealing relationship on the neck portions of their respective bottles.

7. The method of claim 6, wherein said sterile bottle caps are introduced into said hood in a unitary sterile package, and said package is opened withing the hood.

8. The method of claim 6, further including the step of adding desired amounts of dilutant to said IV bottles within said hood after removing the packing cap portions and prior to press-fitting the bottle necks into the sterile caps.

9. The method of claims 6 or 7, wherein said IV bottles are initially disposed on the floor of the hood in an upright position with their neck portions facing upward, and said bottles are inverted prior to press-fitting their neck portions into said sterile caps.

10. The method of claims 1, 4 or 7, wherein said sterile cap package comprises a sterilized disposable plastic bag.

* * * * *